United States Patent [19]

Metcalf

[11] 4,060,214

[45] Nov. 29, 1977

[54] MERCHANDISE DISPLAY STAND

[75] Inventor: Derek N. G. Metcalf, La Grange Park, Ill.

[73] Assignee: Athena Industries, Inc., La Grange, Ill.

[21] Appl. No.: 741,965

[22] Filed: Nov. 15, 1976

[51] Int. Cl.[2] ..... F16M 11/32

[52] U.S. Cl. ..... 248/165; 248/188.7

[58] Field of Search ..... 248/188.7, 165, 519, 248/523, 525, 526, 529; 211/131

[56] References Cited

U.S. PATENT DOCUMENTS

| | | | |
|---|---|---|---|
| 2,071,887 | 2/1937 | Malin et al. | 248/529 |
| 3,141,557 | 7/1964 | Marschak | 248/165 |
| 3,206,150 | 9/1965 | Lang et al. | 248/188.7 |
| 3,787,018 | 1/1974 | Nathan | 248/188.7 |

FOREIGN PATENT DOCUMENTS

| | | | |
|---|---|---|---|
| 37,607 | 11/1886 | Germany | 248/529 |

*Primary Examiner*—Robert A. Hafer

*Attorney, Agent, or Firm*—McCaleb, Lucas & Brugman

[57] ABSTRACT

A counter-top stand for displaying merchandise, in which a tubular support pole is held in operationally upright position by a ground engaging base or pedestal and mounts at least one support member from which merchandise display racks or baskets are suspended outwardly about the support pole. The base or pedestal is provided with a plurality of circumferentially spaced ground engaging legs, each having an upstanding inner end portion. The several legs are fixed to a central base ring with the upstanding ends thereof projecting upwardly for insertion into the lower interior of the pole. Connection between the legs and ring is such as to pitch the latter downwardly from the general plane of the ring and thereby angularly diverging their several upstanding end portions. Downward pressure on the base ring flexes the same to converge the upstanding end portions of the legs toward one another whereby to permit their insertion into the open lower end of the tubular pole. Upon release of the ring the end portions again diverge outwardly to tightly grip the interior sidewalls of the pole.

7 Claims, 5 Drawing Figures

MERCHANDISE DISPLAY STAND

BACKGROUND OF THE INVENTION

The present invention relates generally to display systems and more particularly to improved support means for mounting article carrying display racks or baskets.

Prior to this invention, display systems employing pedestal supported poles for carrying article display racks or baskets have been widely known. Among such prior art structures, illustrative of the general class of display stands to which the present invention particularly pertains, is that disclosed in my prior U.S. application Ser. No. 554,311 filed Feb. 28, 1975 or as shown in U.S. Pat. No. 3,921,813 issued Nov. 25, 1975. As taught therein, the support pedestal may comprise a lightweight metal rod structure, such as illustrated in my prior application, or a relatively heavy cast metal or weighted base, as set out in U.S. Pat. No. 3,921,813. As typified by the prior art, previous support systems generally have contemplated structures in which the bottom end of the support pole is inserted into a free or open socket provided by the support base or pedestal. While such freestanding support structures are generally satisfactory, particularly in a static mode, they do not provide positive interconnection of the pole and base and, therefore, are not readily portable.

In brief the present invention comprises an improved pole and support combination and more specifically is directed to an improved means for positively interconnecting a support base or pedestal and a pole of a support stand. Specifically the improved base and pole combination of this invention comprises a stablizing ground engaging pedestal employing at least three circumferentially spaced legs having the outer ends thereof adapted for engagement with an underlying support surface and the inner or opposite ends thereof upturned to form linear fingers disposed substantially at right angles to the major axis of the legs for frictional connection with the pole. The several base legs are stabilized by an interconnecting central base ring to which they are rigidly affixed so as to depend at a downward pitch or incline therefrom. The pitch of the legs produces a corresponding divergent separation of the upturned inner end or finger portions thereof, with the speed or divergence thereof being greater than the internal diameter of the support pole. Insertion of the finger portions into the hollow lower end of the support pole is effected by pressing the legs or base ring downwardly to torque load the base ring which acts as a disc spring, causing the separated outer ends of the finger portions to converge for insertion into the interior of the support pole. Release of the base ring springs the fingers toward their divergent positions to provide a resilient gripping engagement with the pole. Thus a positive interconnection system is provided between the base pedestal and tubular support pole whereby the same are readily portable as an integrated unit.

Among the several objects of this invention is that of providing improved interconnection means between an upright pole and a ground engaging support pedestal therefor.

Another important object of this invention is to provide an improved portable base and pole combination for use in merchandise display racks, and the like.

Still another important object of this invention is to provide improved means for connecting a support base and pole embodying disc spring means.

A further object of this invention is to provide an improved support base for a pole comprising resilient connector means.

A still further object of this invention is to provide an improved support stand, comprising an upright pole and support base, which exhibits improved economy of manufacture and assembly and convenience of utilization.

Having thus described this invention, the above and further object features and advantages thereof will appear from the following detailed description of a preferred embodiment illustrated in the accompanying drawings and comprising the best made presently contemplated so as to enable those skilled in the art to make and practice this invention.

Figure 1:
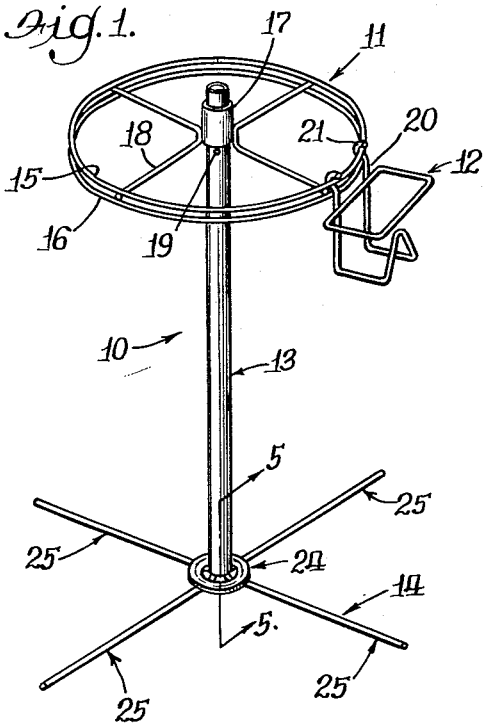
FIG. 1 is a perspective showing of a merchandise display stand in accordance with this invention.

Turning now to the particular embodiment of this invention, illustrated in the accompanying drawings, specific reference is made to FIG. 1 wherein a countertop merchandise display assembly 10 comprises one or more support means 11, adapted to carry a plurality of individual merchandise display baskets 12 about its periphery, mounted to rotate about the upper end of a vertically upright support pole 13 which is stabilized on a ground engaging support pedestal 14.

Inasmuch as the particular support means 11 and the display baskets 12 illustrated are not essential elements of the present invention other than to show a preferred context of use, the same will not be described in detail herein, reference being made to my prior pending application, Ser. No. 554,311, above noted, for the structural details and operational aspects thereof. In brief, however, the illustrative support means 11 comprises a generally annular wheel formed with a pair of closed annular and vertically spaced rims or rails 15, 16, formed of a relatively heavy wire stock. Such rails are suitably joined to a central tubular hub 17 by means of intervening spoke arms 18; the outer ends of the spoke arm extending between the superposed rails 15 and 16 and having welded connection therewith. Similarly the inner ends of the spoke arms are fixed to the hub 17. Hub 17 is rotatably supported over the outer end of the support pole 13 on a transversely extending cotter pin 19 or the like. The space between the rims or rails 15 and 16 provides convenient means for interconnection with the display baskets 12 comprising wire formed receptacles presenting an open top compartment for receiving and displaying articles of merchandise and including parallel spaced upstanding arm portions 20 having hook portions 21 at the outer ends thereof which are insertable between the rails 15 and 16 for detachable interconnection therewith. Obviously other support means and merchandise display baskets or racks may be used with the improved base pedestal and support pole combination of this invention, as will appear presently. Be that as it may, the support means 11 and merchandise display baskets 12 shown suffice to demonstrate the context of use of the herein shown and described preferred embodiment of this invention.

Turning now to the specifics of the support pole 13, the same is shown as a single length of hollow tubular metal, but may, according to known practice, combine one or more interfitted sections or lengths of tubing to accommodate selected display stand elevations. Additionally pole 13 need not be tubular, so long as the lower end thereof provides an open-ended socket or chamber for connection with the support pedestal 14 in accordance with the concepts of this invention.

As best shown in FIGS. 1–4 of the drawings, base pedestal 14 of this invention comprises a centrally located metal base ring 24 and four radially extending ground engaging support legs 25 fixed thereto. In this latter regard a tripod support would suffice utilizing three legs in lieu of the four illustrated, but the four leg structure shown is preferred.

Figure 2:
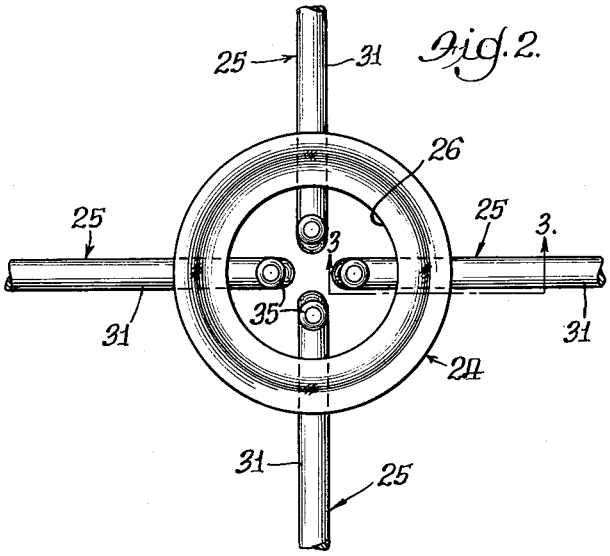
FIG. 2 is an enlarged partial top plan view of the support pedestal illustrated in FIG. 1, with portions broken away.
Figure 4:
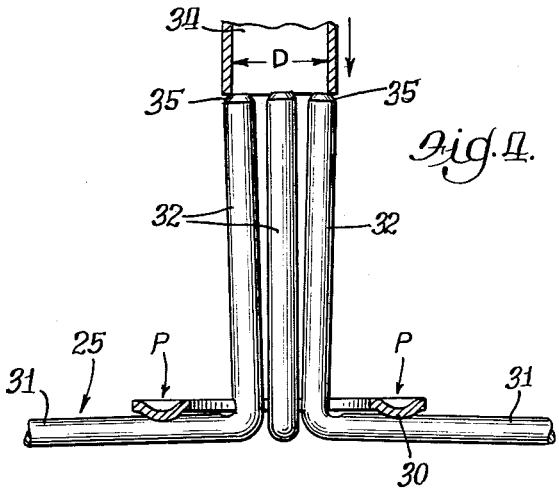
FIG. 4 is a side elevational view of the pedestal portion illustrated in FIG. 2.
Figure 3:
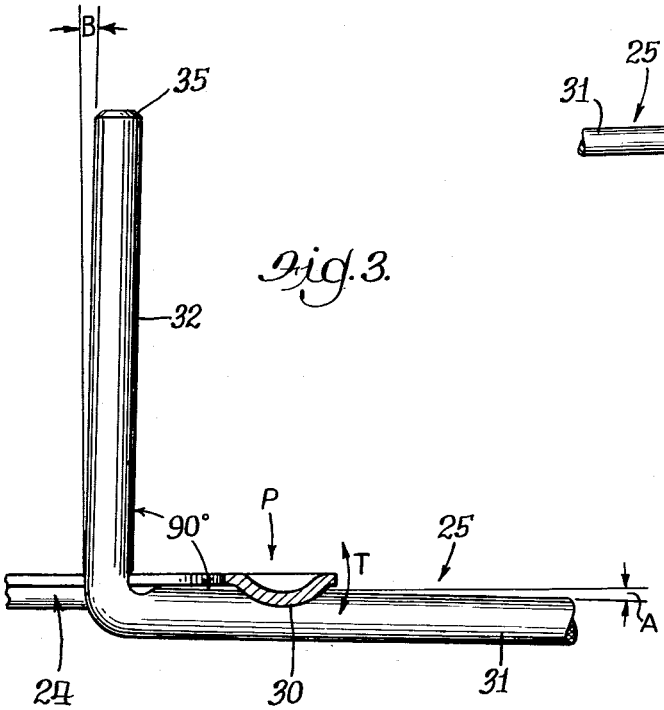
FIG. 3 is an enlarged partial view in side elevation with portions in section, taken substantially along vantage line 3—3 of FIG. 2.

Turning now to the particulars of the base ring 24, specific reference is made to FIGS. 2, 3, and 4 of the drawings from which it will be recognized that ring 24 comprises an annular metal member having a central opening 26 and, in the particular illustrated case, a cross section of generally semi-circular formation distinguished by a concave-convex bead portion 30 disposed generally centrally of the inner and outer circumferences of the ring member. The bead formation provides a convenient depending area on the lower side of the ring for welded attachment to the several support legs 25 as will appear presently.

As previously noted the illustrated base assembly 14 includes four support legs 25, each of which has a generally elongated linear arm portion 31, having a right angularly upturned finger portion 32 at one end thereof. The finger portions 32 of the several legs are substantially shorter than the arm portions thereof so that the resulting shape of each of the legs is substantially that of an L. In the particular embodiment illustrated the several legs 25 are formulated of heavy wire rod of generally cylinder cross section although obviously other cross sectional configurations are equally suitable.

As best shown in FIGS. 3 and 4 of the drawings, the legs 25 are affixed to the underside of the bead 30 of the base ring 24 as by spot welding the latter to the arm portions 31 at equal distances from their respective finger portions 32 so that the latter are located at like radial distances about the central axis of the base ring and extend upwardly from its central opening 26. This relationship is best illustrated in FIGS. 2 and 4.

It is of particular importance to note (see FIG. 3) that the weld interconnection between the beaded portion 30 of the base ring and the arm portions 31 of each of the legs 25 is such as to angulate the arm portions 31 downwardly from the general plane of formation of the ring member (indicated by angle A in FIG. 3). This permits the outer end of the arm portions to achieve ground engagement with a suitable support, elevating the base ring above the support a distance depending upon the extent or legnth of the arm portions 31 and the depending angle A thereof. Due to the fact that the finger portion 32 of each of the leg members is substantially at a right angle to the axis of its arm portion 31, the like downward pitch or positioning of the several arm portions relative to the formational plane of the ring 24 serves to correspondingly pitch the finger portions outwardly in divergent relationship to a vertical axis passing centrally through the base ring. This relationship is best illustrated in FIG. 3 as indicated by the angle of divergence B. It will be recognized that with right angular relationship between the arm and finger portions 31 and 32 of each leg member, angles A and B are substantially equal. The relationship of the assembled ring member with the several leg members 25 is best shown in FIG. 4 of the drawings from which the outwardly divergent attitude of the assembled finger portions is clearly recognizable.

As best shown in FIG. 4, the divergence of the finger portions 32 and particularly the separation between the outer ends 33 thereof is selected by regulating the pitch angle A and diverging angle B along with the linear extent of each of the fingers 32 so that the spread or distance between opposing fingers 32 is greater than the internal diameter D of the socket or chamber 34 at the bottom end of pole 13. It further will be noted that the extreme ends of each of the finger portions is suitably chamfered to provide a frusto-conical cam surface 35 thereon, the importance of which will be recognized presently.

Figure 5:
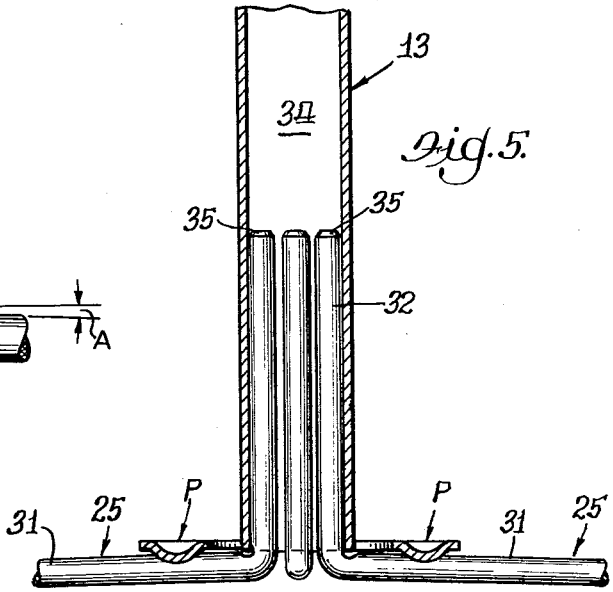
FIG. 5 is an enlarged cross sectional view taken substantially along vantage line 5—5 of FIG. 1 and looking in the direction of the arrows thereon to illustrate the interlocked relationship of the base pedestal and support pole.

With the above described arrangement, application of pressure P to the base ring 24 in a downward direction (see FIG. 4) causes the elongated lever arms provided by the extending ground engaging arm portions 31 of the several leg members 25 to torsionally load the base ring in accordance with the principles of a conical disc or Belleville spring, as indicated by arrow T in FIG. 3; the arm portions 31 being rigidly affixed to the ring as previously described. This activity or torquing of the base ring effectively moves the several finger portions 32 toward one another converging their spread sufficiently to permit their insertion into the socket or chamber 34 at the lower end of the support pole 13. Subsequent downward movement of the support pole over the ends of the finger portions 32 permits the pole to move downwardly into eventual engagement with the arm portions 31 of the legs within the open center 26 of the base ring, as shown in FIG. 5 of the drawings. Release of the pressure P on the ring member urges the several finger portions 32 to return to their divergent positions, illustrated in FIGS. 3 and 4, and thereby produces a tight resilient gripping action between the fingers and the surrounding walls of the support pole. Thus the pole and the support base or pedestal are resiliently interlocked.

In practice, as best illustrated in FIG. 4, downward pressure on the base ring may be applied indirectly by pushing downwardly on the tubular pole so as to cam the tube walls past the outer ends of the several fingers 32 as assisted by the chamfered outer ends 35 thereof effecting entry of the fingers within the interior of chamber 34. This practical operation is limited however in accordance with the diverging angle or spread of the fingers requiring that such divergence be restricted to the point where the cam surface ends of the fingers are engaged with the outer end of the tubular pole, as illustrated in FIG. 4. If the divergence of the fingers is selected to a greater degree so as to increase gripping action with the interior of the pole 13, then direct application of downward pressure on ring 24 is called for. In either case however, the base ring flexes under torque load to move the fingers toward each other.

From the foregoing, it is believed that those familiar with the act will recognize the improved structural and operational advancement provided by this invention, and while the same has been described in association with a particular preferred embodiment of its principles and concepts, such is obviously susceptible to variation and substitution of equivalents. Thus it is intended that this invention be unlimited by the foregoing described and illustrated embodiment, except as may appear in the following appended claims.

The embodiments of the invention in which an exclusive property or privilege is claimed are defined as follows:

1. In an upright merchandise display stand and the like, the combination of a central support pole having an internal chamber opening inwardly of its lower end, and a base pedestal for supporting said pole upright and comprising a base ring, operationally located centrally beneath the pole's lower end, and plural leg members affixed to said ring; each leg member having an elongated ground engaging arm portion extending radially ouwardly and downwardly from said ring and an upstanding inner end portion forming a linear finger projecting above the central opening of said ring in diverging relation to a vertical axis passing centrally therethrough; said ring operationally moving under vertical load simultaneously to converge said finers for insertion into said chamber whereby to frictionally interconnect said pole and pedestal.

2. The combination of claim 1 wherein said ring is formed with a generally concave-convex cross section and has the operational characteristics of a disc spring.

3. The combination of claim 1 wherein each said leg member is substantially L shaped with the respective inner end portion thereof disposed generally at right angles to said arm portion thereof.

4. The combination of claim 1 wherein said pole is tubular and the outer ends of said fingers are formed with cooperating caming surfaces to assist entry of said fingers into the interior of said pole.

5. In a display stand and the like having a tubular member detachably secured to support means, the combination comprising: an annular ring, and plural rigid leg members affixed thereto; each said leg member comprising an elongated support arm portion having an outturned finger portion at one end thereof, the several arm portions being rigidly fixed to said ring to radiate outwardly therefrom with the several finger portions thereof adjacent and extending over the open center of said ring in divergent relation about a central axis passing therethrough; and said ring being operationally flexible about its annular axis whereby to converge said finger portions towards said central axis for inserted connection with the tubular member.

6. The combination of claim 5 wherein said arm and finger portions are integrally formed from a single length of rod-like metal, with the said finger portions being related at substantially right angles to said arm portions and substantially shorter than the latter to effect a general L shape for each leg member.

7. The combination of claim 5 wherein said ring is rigidly affixed to each leg member adjacent said finger portion thereof and is operational to resiliently bias said finger portions away from one another whereby to frictionally lock the same against the interior of the tubular member.

* * * * *